US010398167B2

(12) United States Patent
Akiyama et al.

(10) Patent No.: US 10,398,167 B2
(45) Date of Patent: Sep. 3, 2019

(54) BURNING TYPE HEAT SOURCE, FLAVOR INHALER, AND MANUFACTURING METHOD OF BURNING TYPE HEAT SOURCE

(71) Applicant: JAPAN TOBACCO INC., Tokyo (JP)

(72) Inventors: Takeshi Akiyama, Tokyo (JP); Atsuro Yamada, Tokyo (JP); Manabu Takeuchi, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 590 days.

(21) Appl. No.: 14/844,301

(22) Filed: Sep. 3, 2015

(65) Prior Publication Data

US 2015/0374037 A1 Dec. 31, 2015

Related U.S. Application Data

(63) Continuation of application No. PCT/JP2014/055270, filed on Mar. 3, 2014.

(30) Foreign Application Priority Data

Mar. 5, 2013 (JP) ..... 2013-043279

(51) Int. Cl.
*A24F 47/00* (2006.01)
*A24B 15/16* (2006.01)

(52) U.S. Cl.
CPC ..... *A24F 47/006* (2013.01); *A24B 15/165* (2013.01)

(58) Field of Classification Search
CPC ..... A24F 47/006; A24B 15/165
See application file for complete search history.

(56) References Cited

U.S. PATENT DOCUMENTS

| | | | | |
|---|---|---|---|---|
| 4,981,522 | A * | 1/1991 | Nichols | A24B 15/165 131/194 |
| 5,020,548 | A | 6/1991 | Farrier et al. | |
| 5,119,834 | A | 6/1992 | Shannon et al. | |
| 2007/0215168 | A1 | 9/2007 | Banerjee et al. | |
| 2013/0146075 | A1* | 6/2013 | Poget et al. | A24F 47/008 131/329 |

FOREIGN PATENT DOCUMENTS

| | | | |
|---|---|---|---|
| EP | 2 070 682 | A1 | 6/2009 |
| JP | 63-214173 | A | 9/1988 |

(Continued)

OTHER PUBLICATIONS

International Search Report, issued in PCT/JP2014/055270, dated Jun. 3, 2014.

(Continued)

*Primary Examiner* — Michael J Felton
*Assistant Examiner* — Katherine A Will
(74) *Attorney, Agent, or Firm* — Birch, Stewart, Kolasch & Birch, LLP

(57) ABSTRACT

A burning type heat source (50) has a single longitudinal hollow (51) extending along the first direction (D1). The longitudinal hollow (51) includes: a first hollow (51A) having a first cross section area; and a second hollow (51B) having a second cross section area smaller than the first cross section area. The first cross section area of the first hollow (51A) is 1.77 $mm^2$ or more.

13 Claims, 7 Drawing Sheets

(56) References Cited

FOREIGN PATENT DOCUMENTS

| | | | |
|---|---|---|---|
| JP | 2009-529872 | A | 8/2009 |
| JP | 2011-505823 | A | 3/2011 |

OTHER PUBLICATIONS

Japanese Notification of Reasons for Refusal for Japanese Application No. 2016-123963, dated Jul. 4, 2017, with a Machine translation.
European Communication pursuant to Article 94(3) EPC, dated Jun. 15, 2018 for Application No. 17 159 698.4.

* cited by examiner

FIG. 8

| | first hollow | second hollow | | | | | highest temperature during ignition | temperature decrease rate |
|---|---|---|---|---|---|---|---|---|
| | diameter (φ) | diameter (φ) | length | flow path circumferential length | flow path cross section area | flow path cross section area/ (flow path circumferential length * length) | | |
| | [mm] | [mm] | [mm] | [mm] | [mm2] | [-] | [°C] | [-] |
| Comp. Ex. 1 | 1.5 (1.77mm2) | - | - | - | - | - | 995.1 | 1.00 |
| Ex. 1 | | 0.8 | 1.0 | 2.51 | 0.50 | 0.200 | 948.0 | 0.95 |
| Ex. 2 | | 1.0 | 1.0 | 3.14 | 0.79 | 0.250 | 927.2 | 0.93 |
| Ex. 3 | | 1.0 | 2.0 | 3.14 | 0.79 | 0.125 | 773.3 | 0.78 |
| Ex. 4 | | 1.0 | 3.0 | 3.14 | 0.79 | 0.083 | 785.8 | 0.79 |
| Ex. 5 | | 1.0 | 5.0 | 3.14 | 0.79 | 0.050 | 693.3 | 0.70 |
| Ex. 6 | | 1.2 | 2.0 | 3.77 | 1.13 | 0.150 | 876.0 | 0.88 |
| Comp. Ex. 2 | 2.5 (4.90mm2) | - | - | - | - | - | 1,286.3 | 1.00 |
| Ex. 7 | | 0.6 | 5.0 | 1.88 | 0.28 | 0.030 | 758.6 | 0.59 |
| Ex. 8 | | 0.8 | 5.0 | 2.51 | 0.50 | 0.040 | 760.7 | 0.59 |
| Ex. 9 | | 1.0 | 1.0 | 3.14 | 0.79 | 0.250 | 1,201.9 | 0.93 |
| Ex. 10 | | 1.0 | 3.0 | 3.14 | 0.79 | 0.083 | 961.8 | 0.75 |
| Ex. 11 | | 1.0 | 5.0 | 3.14 | 0.79 | 0.050 | 871.0 | 0.68 |
| Ex. 12 | | 1.0 | 8.0 | 3.14 | 0.79 | 0.031 | 810.2 | 0.63 |
| Ex. 13 | | 1.0 | 11.0 | 3.14 | 0.79 | 0.023 | 747.7 | 0.58 |
| Ex. 14 | | 1.0 | 13.0 | 3.14 | 0.79 | 0.019 | 753.8 | 0.59 |
| Ex. 15 | | 1.2 | 5.0 | 3.77 | 1.13 | 0.060 | 906.6 | 0.70 |
| Ex. 16 | | 1.2 | 2.0 | 3.77 | 1.13 | 0.150 | 1,091.1 | 0.85 |
| Ex. 17 | | 1.4 | 5.0 | 4.40 | 1.54 | 0.070 | 980.0 | 0.76 |
| Ex. 18 | | 1.4 | 2.0 | 4.40 | 1.54 | 0.175 | 1,186.1 | 0.92 |

BURNING TYPE HEAT SOURCE, FLAVOR INHALER, AND MANUFACTURING METHOD OF BURNING TYPE HEAT SOURCE

CROSS REFERENCE TO RELATED APPLICATIONS

This application is a Continuation of PCT International Application No. PCT/JP2014/055270, filed on Mar. 3, 2014, which claims priority under 35 U.S.C. 119(a) to Patent Application No. 2013-043279, filed in Japan on Mar. 5, 2013, all of which are hereby expressly incorporated by reference into the present application.

TECHNICAL FIELD

The present invention relates to a burning type heat source extending along a direction from an ignition end toward a non-ignition end, a flavor inhaler including the burning type heat source, and a manufacturing method of the burning type heat source.

BACKGROUND ART

Conventionally, instead of cigarette, a flavor inhaler (smoking article) is proposed which allows for tasting a flavor without burning a flavor source such as a tobacco. For example, there is known a flavor inhaler including: a burning type heat source extending along a direction from an ignition end toward a non-ignition end (hereinafter, referred to as "longitudinal axis direction"; and a holder that holds the burning type heat source. There are various types of proposals for such a flavor inhaler.

For example, Patent Literature 1 discloses a burning type heat source having a hollow extending along a longitudinal direction. A base which is configured by a porous carbon, etc., including aerosol is provided at a non-ignition end side of the hollow in the burning type heat source.

The burning type heat source used for the flavor inhaler is desirably capable of supplying a sufficient and stable heat amount over a plurality of puffs (inhalations) performed from ignition to extinction.

As a result of extensive studies, the inventors found that when a burning type heat source having a tubular shape with only a single hollow extending along the longitudinal axis direction being formed therein is used, for example, so as to reduce a contact area between air flown in during puffing and a burning area, it is possible to restrain a variation amount between an amount of heat to be generated during non-puffing (during natural burning) and an amount of heat to be generated during puffing to supply a stable heat amount in a puff performed from the middle to the latter half.

However, as a result of further studies, the inventors found that when a flame having a relatively low directivity as in a gas lighter used generally and widely for igniting a cigarette is used for igniting a burning type heat source, a flame of the gas lighter is flown in from the hollow of the burning type heat source when a user inhales, which results in a concern over burning of a member arranged at a later part of the burning type heat source and worsening of a flavor inhaling taste.

Thus, it is very difficult to achieve both to supply a stable heat amount in a puff performed from the middle to the latter half and to restrain a flame of a gas lighter from flowing into during ignition.

CITATION LIST

Patent Literature

[Patent Literature 1] U.S. Pat. No. 5,119,834

SUMMARY

A burning type heat source according to a first feature extends along a first direction from an ignition end toward a non-ignition end, and has a single longitudinal hollow extending along the first direction. The longitudinal hollow includes: a first hollow having a first cross section area in a perpendicular cross section perpendicular to the first direction; and a second hollow located at a non-ignition end side relative to the first hollow, the second hollow having a second cross section area smaller than the first cross section area in the perpendicular cross section. The first cross section area is 1.77 $mm^2$ or more.

In the first feature, the second hollow satisfies a condition of $S/(C \times L2) \leq 0.25$, where S is the second cross section area, C is a circumferential length of the second hollow in the perpendicular cross section, and L2 is a length of the second hollow in the first direction.

In the first feature, the second hollow satisfies a condition of $S/(C \times L2) \geq 0.06$, where S is the second cross section area, C is a circumferential length of the second hollow in the perpendicular cross section, and L2 is a length of the second hollow in the first direction.

In the first feature, the second hollow satisfies a condition of $S/(C \times L2) \geq 0.019$.

In the first feature, the second cross section area is 1.54 $mm^2$ or less. A length of the second hollow in the first direction is 2 mm or more and 13 mm or less.

In the first feature, the second cross section area is 1.13 $mm^2$ or less. A length of the second hollow in the first direction is 5 mm or more and 11 mm or less.

In the first feature, an inner wall surface forming the second hollow is configured by a substance having a non-flammable composition.

In the first feature, the burning type heat source has a cylindrical shape extending along the first direction. An outer diameter of the burning type heat source is 3 mm or more and 15 mm or less.

In the first feature, a length of the burning type heat source in the first direction is 5 mm or more and 30 mm or less.

A flavor inhaler according to a second feature includes: a burning type heat source extending along a first direction from an ignition end toward a non-ignition end and having a single longitudinal hollow extending along the first direction; and a holder that holds the burning type heat source. The longitudinal hollow includes: a first hollow having a first cross section area in a perpendicular cross section perpendicular to the first direction; and a second hollow located at a non-ignition end side relative to the first hollow, the second hollow having a second cross section area smaller than the first cross section area in the perpendicular cross section. The first cross section area is 1.77 $mm^2$ or more.

A manufacturing method of a burning type heat source according to a third feature is a manufacturing method of a burning type heat source extending along a first direction from an ignition end toward a non-ignition end. The manufacturing method of a burning type heat source comprises: a step A of forming a first tubular member configured by an outer layer configured by a flammable substance through dual extrusion toward the first direction, an inner layer laminated inside the outer layer and configured by a non-flammable substance, and a hollow formed inside the inner layer; and a step B of cutting the inner layer along the first direction from one side of the first tubular member in the first direction.

BRIEF DESCRIPTION OF DRAWINGS

FIG. 8 is a drawing for describing an experiment result.

DESCRIPTION OF EMBODIMENTS

Figure 1:
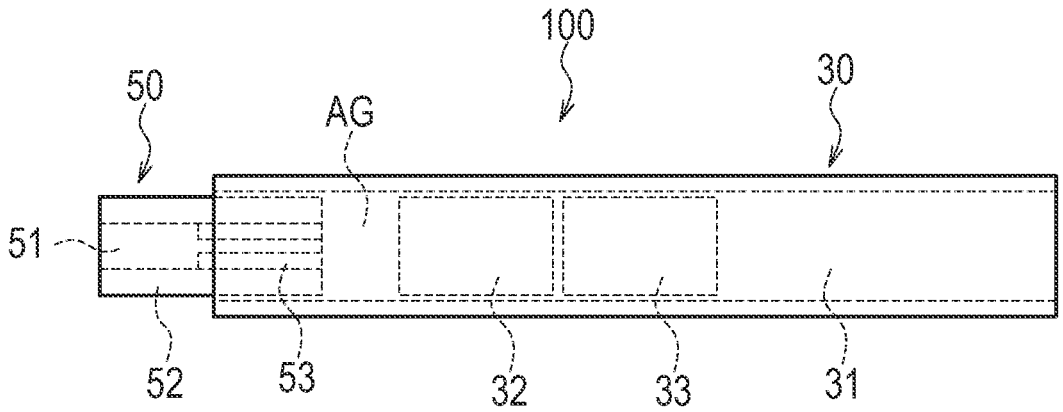
FIG. 1 is a drawing showing a flavor inhaler 100 according to a first embodiment.

Hereinafter, the embodiments of the present invention will be described with reference to the drawings. In the following drawings, identical or similar components are denoted by identical or similar reference numerals.

Therefore, specific dimensions should be determined with reference to the description below. It is needless to mention that different relationships and ratio of dimensions may be included in different drawings.

SUMMARY OF EMBODIMENT

A burning type heat source according to an embodiment extends along a first direction from an ignition end toward a non-ignition end, and has a single longitudinal hollow extending along the first direction. The longitudinal hollow includes: a first hollow having a first cross section area in a perpendicular cross section perpendicular to the first direction; and a second hollow located at a non-ignition end side relative to the first hollow, the second hollow having a second cross section area smaller than the first cross section area in the perpendicular cross section. The first cross section area is 1.77 $mm^2$ or more.

In an embodiment, a burning type heat source has a single longitudinal hollow extending along a first direction, and a first cross section area of a first hollow is 1.77 $mm^2$ or more. Therefore, when a contact area between air flown in during puffing and a burning area is reduced, it is possible to restrain a variation amount between a amount of heat to be generated during non-puffing (during natural burning) and a amount of heat to be generated during puffing to supply a stable heat amount in a puff performed from the middle to the latter half.

When the first cross section of the first hollow is circular, the first cross section area is 1.77 $mm^2$ (diameter $\varphi$=1.5 mm).

In an embodiment, the longitudinal hollow includes a first hollow having a first cross section area and a second hollow having a second cross section area smaller than the first cross section area. The second hollow is located at a non-ignition end side relative to the first hollow. Therefore, air sucked from an ignition end side into the longitudinal hollow is led through the first hollow and the second hollow to a non-ignition end side. It is thought that the air narrowed in the second hollow becomes thin in laminar film as a result of an increase in flow velocity when the air passes through the second hollow, which accelerates heat exchange with a second hollow tubular wall. This restrains a flame of a gas lighter during ignition from flowing into the longitudinal hollow.

Thus, it is possible to achieve both to supply a stable heat amount in a puff performed from the middle to the latter half and to restrain a flame of a gas lighter from flowing into during ignition.

First Embodiment (Flavor Inhaler)

Figure 2:
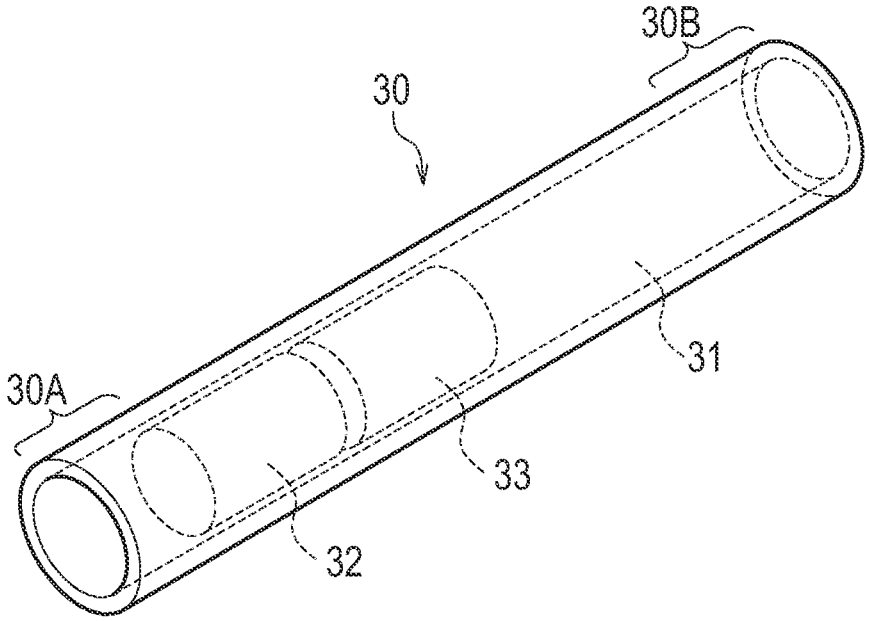
FIG. 2 is a drawing showing a holder 30 according to the first embodiment.
Figure 3:
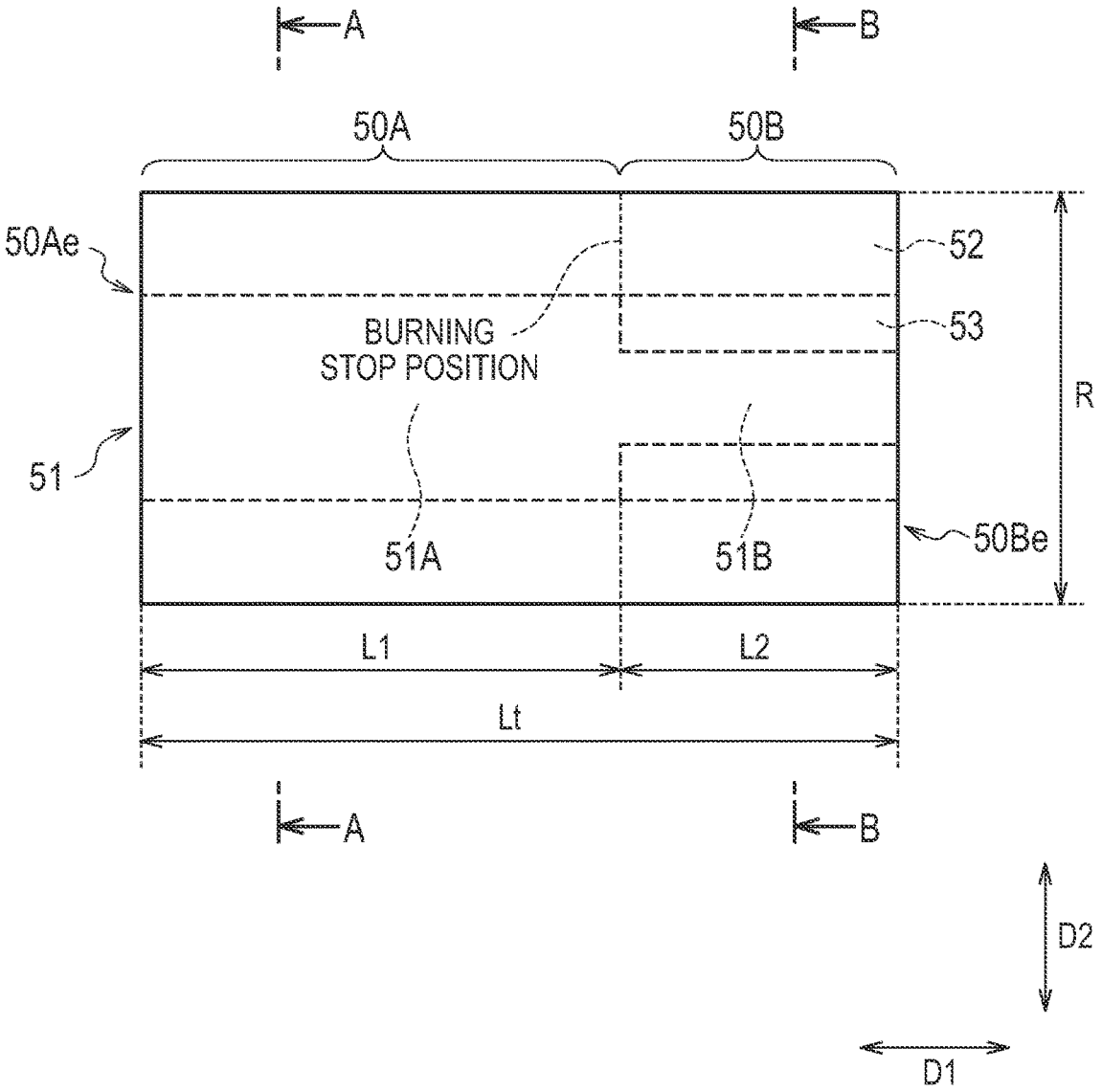
FIG. 3 is a drawing showing a burning type heat source 50 according to the first embodiment.
Figure 4:
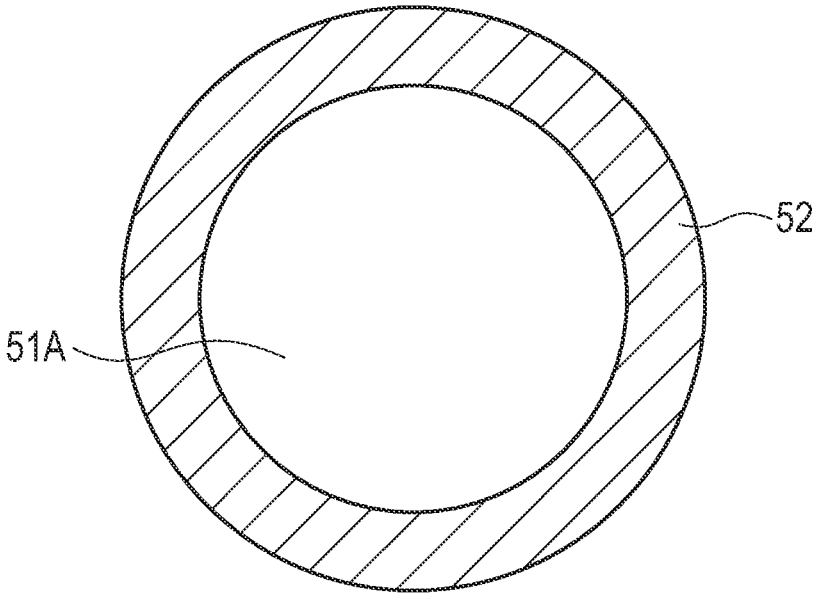
FIG. 4 is a drawing showing an A-A cross section shown in FIG. 3.
Figure 5:
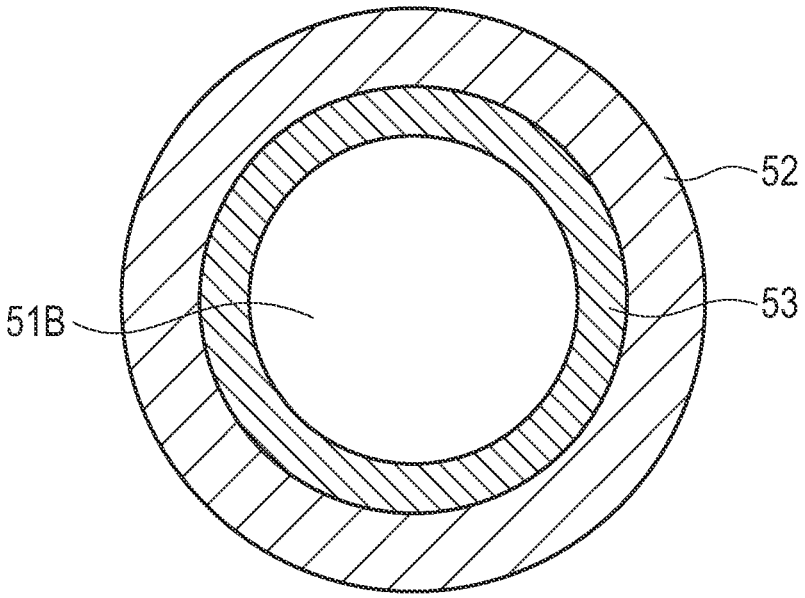
FIG. 5 is a drawing showing a B-B cross section shown in FIG. 3.

A flavor inhaler according to a first embodiment will be described, below. FIG. 1 is a drawing showing a flavor inhaler 100 according to the first embodiment. FIG. 2 is a drawing showing a holder 30 according to the first embodiment. FIG. 3 is a drawing showing a burning type heat source 50 according to the first embodiment. FIG. 4 is a drawing showing an A-A cross section of the burning type heat source 50 shown in FIG. 3. FIG. 5 is a drawing showing a B-B cross section of the burning type heat source 50 shown in FIG. 3.

As shown in FIG. 1, the flavor inhaler 100 has a holder 30 and a burning type heat source 50. In the first embodiment, it should be noted that the flavor inhaler 100 is a flavor inhaler without burning a flavor source.

As shown in FIG. 2, the holder 30 holds the burning type heat source 50. The holder 30 has a supporting end portion 30A and a mouthpiece side end portion 30B. The supporting end portion 30A is an end portion that holds the burning type heat source 50. The mouthpiece side end portion 30B is an end portion provided at a mouthpiece side of the flavor inhaler. In the first embodiment, the mouthpiece side end portion 30B configures a mouthpiece of the flavor inhaler 100. However, a mouthpiece of the flavor inhaler 100 may be provided separately of the holder 30.

The holder 30 has a tubular shape with a hollow 31 extending along a direction from the supporting end portion 30A toward the mouthpiece side end portion 30B. For example, the holder 30 has a cylindrical shape or a rectangular tubular shape.

In the first embodiment, the holder 30 may be configured by a paper tube formed as a hollow tubular body, which is obtained so that rectangular-shaped thick paper is bent into a cylindrical shape after which the both edge portions are joined to each other.

In the first embodiment, the holder 30 houses a flavor source 32 and a straightening member 33. The flavor source 32 has a columnar shape, which is formed by covering a powdery and granular tobacco leaf with a sheet having air permeability, for example. The straightening member 33 is provided at the mouthpiece side end portion 30B side with respect to the flavor source 32. The straightening member 33 has a through hole extending along a direction from the supporting end portion 30A toward the mouthpiece side end portion 30B. The straightening member 33 is formed by a member that does not have air permeability.

In the first embodiment, a case in which the holder 30 has a tubular shape is shown as an example; however, the embodiment is not limited thereto. That is, the holder 30 may have a configuration for holding the burning type heat source 50.

Here, as shown in FIG. 1, an air gap AG is preferably provided between the burning type heat source 50 held by the holder 30 and the flavor source 32 provided in the holder 30.

As shown in FIG. 3, the burning type heat source 50 has an ignition end portion 50A and a non-ignition end portion 50B. The ignition end portion 50A is an end portion that is exposed from the holder 30 in a state where the burning type heat source 50 is inserted into the holder 30. The non-ignition end portion 50B is an end portion that is inserted into the holder 30.

Specifically, the burning type heat source 50 has a shape extending along a first direction D1 from an ignition end 50Ae toward a non-ignition end 50Be. The burning type heat source 50 has a longitudinal hollow 51, an outer layer 52 and an inner layer 53.

The longitudinal hollow 51 extends along the first direction D1 from the ignition end 50Ae toward the non-ignition end 50Be. The longitudinal hollow 51 is preferably provided at an approximately center of the burning type heat source 50 as seen in a perpendicular cross section perpendicular to the first direction D1. That is, the thickness of a wall body (the outer layer 52, or the outer layer 52 and the inner layer 53) configuring the longitudinal hollow 51 is preferably constant in the perpendicular cross section perpendicular to the first direction D1.

In the first embodiment, the longitudinal hollow 51 has a first hollow 51A and a second hollow 51B. It should be noted that the number of the longitudinal hollows 51 formed in the burning type heat source 50 is singular.

The first hollow 51A has a first cross section area in a perpendicular cross section (for example, a cross section shown in FIG. 4) perpendicular to the first direction D1. The first cross section area of the first hollow 51A is 1.77 $mm^2$ or more.

The second hollow 51B has a second cross section area in a perpendicular cross section (for example, a cross section shown in FIG. 5) perpendicular to the first direction D1. The second cross section area is smaller than the first cross section area.

Here, the second cross section area of the second hollow 51B is represented by "S", a circumferential length of the second hollow 51B in the perpendicular cross section (for example, a cross section shown in FIG. 5) perpendicular to the first direction D1 is represented by "C", and a length of the second hollow 51B in the first direction D1 is represented by "L2".

In such a case, the second hollow 51B preferably satisfies a condition of $S/(C \times L2)<0.25$. When such a condition is satisfied, it is possible to restrain a flame of a gas lighter during ignition from flowing into the longitudinal hollow 51 and it is possible to alleviate burning of a member arranged at a later part of the burning type heat source 50 and worsening of a flavor inhaling taste.

Further, the second hollow 51B preferably satisfies a condition of $S/(C \times L2) \leq 0.06$. When such a condition is satisfied, it is possible to restrain a flame of a gas lighter during ignition from flowing into the longitudinal hollow 51 and it is possible to further alleviate burning of a member arranged at a later part of the burning type heat source 50 and worsening of a flavor inhaling taste.

Further, the second hollow 51B preferably satisfies a condition of $S/(C \times L2) \geq 0.019$. As a result of such a condition being satisfied, when a user inhales air in a state of the flavor inhaler 100, a ventilation resistance of the burning type heat source 50 (longitudinal hollow 51) does not rise too excessively and inhibition of suction of air is restrained.

When a condition of $S/(C \times L2)<0.25$ is at least satisfied, it is preferable that the second cross section area S of the second hollow 51B is 1.54 $mm^2$ or less and a length (L2) of the second hollow 51B in the first direction D1 is 2 mm or more and 13 mm or less.

When a condition of $S/(C \times L2)<0.25$ is at least satisfied, in the first direction D1, a ratio (L1/L2) between a length (L1) of the first hollow 51A and a length (L2) of the second hollow 51B is preferably 0.769 or more. This restrains a decrease in number of times of puffs caused due to the first hollow 51A being too short and a decrease in ventilation resistance caused due to the second hollow 51B being too long.

Further, when a condition of $S/(C \times L2)<0.25$ is at least satisfied, in the first direction D1, the ratio (L1/L2) between the length (L1) of the first hollow 51A and the length (L2) of the second hollow 51B is preferably 1.000 or more and 5.000 or less. When the ratio (L1/L2) is 1.000 or more, it is possible to appropriately restrain a decrease in number of times of puffs caused due to the first hollow 51A being too short and a decrease in ventilation resistance caused due to the second hollow 51B being too long. On the other hand, when the ratio (L1/L2) is 5.000 or less, the air is narrowed by the second hollow 51B, and thus, it is possible to appropriately restrain the flame of the gas lighter during ignition from flowing into the longitudinal hollow 51.

Alternatively, when a condition of $S/(C \times L2) \leq 0.06$ is at least satisfied, it is preferable that the second cross section area S of the second hollow 51B is 1.13 $mm^2$ or less and the length (L2) of the second hollow 51B in the first direction D1 is 5 mm or more and 11 mm or less.

The outer layer 52 is configured by a flammable substance. For example, examples of the flammable substance include a mixture comprising a carbonaceous material, a nonflammable additive, a binder (organic binder or inorganic binder), and water. As the carbonaceous material, that which is obtained by removing a volatile impurity through a heat treatment, etc., is preferably used.

The outer layer 52 preferably comprises a carbonaceous material in a range of 10 wt % to 99 wt % when the weight of the outer layer 52 is 100 wt %. In view of a burning characteristic such as supplying of a sufficient heat amount and tightening of ash, the outer layer 52 preferably comprises a carbonaceous material in a range of 30 wt % to 70 wt %, and more preferably comprises a carbonaceous material in a range of 40 wt % to 50 wt %.

Examples of the organic binder may include a mixture including at least one of CMC-Na (carboxymethyl-cellulose sodium), CMC (carboxymethyl cellulose), alginate, EVA, PVA, PVAC, and saccharides.

Examples of the inorganic binder may include a mineral-based binder such as a purified bentonite or a silica-based binder such as colloidal silica, water glass, and calcium silicate.

For example, in view of a flavor, when the weight of the outer layer 52 is 100 wt %, the binder preferably comprises 1 wt % to 10 wt % of CMC-Na, and comprises 1 wt % to 8 wt % of CMC-Na.

Examples of the nonflammable additive may include a carbonate or an oxide including sodium, potassium, calcium, magnesium, and silicon, for example. The outer layer 52 may comprise 40 wt % to 89 wt % of nonflammable additive when the weight of the outer layer 52 is 100 wt %. Further, when calcium carbonate is used as the nonflammable additive, the outer layer 52 preferably comprises 40 wt % to 55 wt % of nonflammable additive.

In order to improve a burning characteristic, the outer layer 52 may comprise 1 wt % or less of alkali metal salts such as sodium chloride when the weight of the outer layer 52 is 100 wt %.

It should be noted that in the first embodiment, as shown in FIG. 4, the outer layer 52 configures an inner wall surface forming the first hollow 51A.

The inner layer 53 is configured by a nonflammable substance. For example, the nonflammable substance includes a nonflammable or flame-retardant inorganic mineral such as calcium carbonate and graphite. For a purpose of reducing carbon monoxide, the nonflammable substance includes calcium carbonate, silicon dioxide, titanium oxide, and iron oxide.

In the first embodiment, it should be noted that as shown in FIG. 5, the inner layer 53 configures an inner wall surface forming the second hollow 51B.

In the first embodiment, the size (Lt shown in FIG. 3) of the burning type heat source 50 in the first direction D1 is preferably 5 mm or more and 30 mm or less. Further, the size (R shown in FIG. 3) of the burning type heat source 50 in the second direction D2 perpendicular to the first direction D1 is preferably 3 mm or more and 15 mm or less.

When the burning type heat source 50 has a cylindrical shape, the size of the burning type heat source 50 in the second direction D2 is an outer diameter of the burning type heat source 50. When the burning type heat source 50 does not have a cylindrical shape, the size of the burning type heat source 50 in the second direction D2 is a maximum value of the burning type heat source 50 in the second direction D2.

In such a case, an end portion of the inner layer 53 located at the ignition end 50Ae side in the first direction D1, that is, a boundary between the first hollow 51A and the second hollow 51B configures a burning stop position. The burning stop position is preferably exposed from the holder 30 in a state where the burning type heat source 50 is held by the holder 30. This restrains burning, etc., of the holder 30.

(Manufacturing Method of Burning Type Heat Source)

Figure 6:
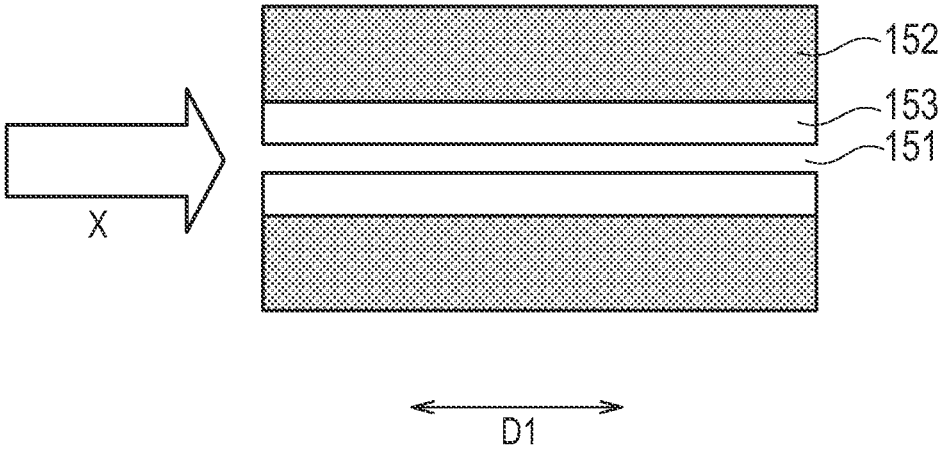
FIG. 6 is a drawing for describing a manufacturing method of a burning type heat source 50 according to the first embodiment.
Figure 7:
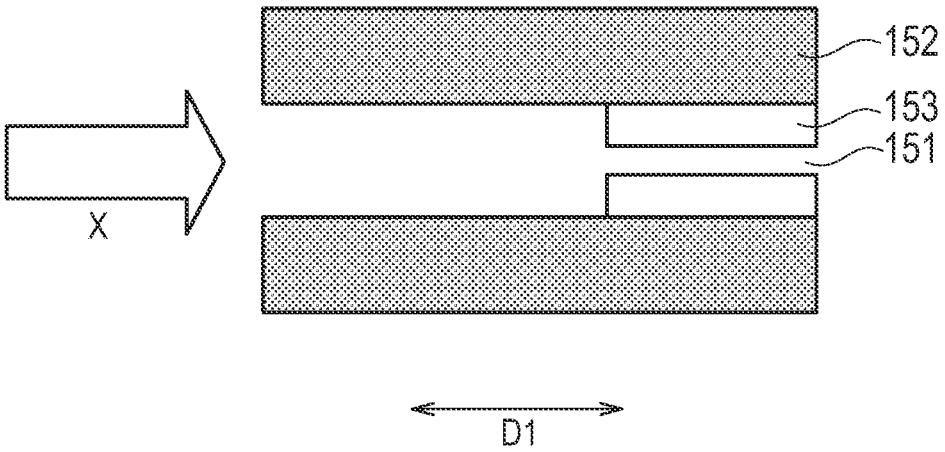
FIG. 7 is a drawing for describing a manufacturing method of a burning type heat source 50 according to the first embodiment.

A manufacturing method of the burning type heat source according to the first embodiment will be described, below. FIG. 6 and FIG. 7 are drawings for describing the manufacturing method of the burning type heat source 50 according to the first embodiment.

As shown in FIG. 6, a first tubular member having a hollow 151, an outer layer 152 and an inner layer 153 is formed in a step A. The first tubular member has a shape extending along the first direction D1.

The hollow 151 extends along the first direction D1, similarly to the longitudinal hollow 51, and is formed by the inner layer 153. Further, the hollow 151 is preferably provided at an approximately center of the first tubular member as seen in a perpendicular cross section perpendicular to the first direction D1.

The outer layer 152 is configured by a flammable substance, similarly to the outer layer 52. The inner layer 153 is configured by a nonflammable substance, similarly to the inner layer 53. The inner layer 153 is laminated inside the outer layer 152.

For example, in the step A, the first tubular member is formed by a dual extrusion toward the first direction D1 (for example, an X direction shown in FIG. 6). The dual extrusion is a formation method in which a substance configuring the outer layer 152 and a substance configuring the inner layer 153 are extruded in a state where the substance configuring the outer layer 152 and the substance configuring the inner layer 153 are laminated each other.

As shown in FIG. 7, in a step B, the inner layer 153 is cut along the first direction D1 from one side of the first tubular member in the first direction D1. A region in which the inner layer 153 is not removed in the step B corresponds to the above-described first hollow 51A. A region in which the inner layer 153 is removed in the step B corresponds to the above-described second hollow 51B.

As a result, it is possible to manufacture the above-described burning type heat source 50, that is, the burning type heat source 50 including the longitudinal hollow 51 having the first hollow 51A and the second hollow 51B.

(Operation and Effect)

In the first embodiment, the burning type heat source 50 has the single longitudinal hollow 51 extending along the first direction D1, and the first cross section area of the first hollow 51A is 1.77 $mm^2$ or more. Therefore, when a contact area between air flown in during puffing and a burning area is reduced, it is possible to restrain a variation amount between a amount of heat to be generated during non-puffing (during natural burning) and a amount of heat to be generated during puffing and it is possible to supply a stable heat amount in a puff performed from the middle to the latter half.

In the first embodiment, the longitudinal hollow 51 includes the first hollow 51A having the first cross section area and the second hollow 51B having the second cross section area smaller than the first cross section area. The second hollow 51B is located at a non-ignition end 50Be side relative to the first hollow 51A. Therefore, air sucked from the ignition end 50Ae side into the longitudinal hollow 51 is led through the first hollow 51A and the second hollow 51B to the non-ignition end 50Be side. It is thought that the air narrowed in the second hollow 51B becomes thin in laminar film as a result of an increase in flow velocity when the air passes through the second hollow 51B, which accelerates heat exchange with a tubular wall configuring the second hollow 51B. This restrains a flame of a gas lighter during ignition from flowing into the longitudinal hollow.

Thus, it is possible to achieve both to supply a stable heat amount in a puff performed from the middle to the latter half and to restrain a flame of a gas lighter from flowing into during ignition.

In the first embodiment, the air gap AG is provided between the burning type heat source 50 held by the holder 30 and the flavor source 32 provided in the holder 30. Therefore, the air narrowed in the second hollow 51B is easily dispersed at a stage when the air finishes passing through the second hollow 51B.

[Experiment Results]

Experiment results will be described, below. FIG. 8 is a table showing the experiment result.

Here, a plurality of samples (comparative example 1, and examples 1 to 6) including a longitudinal hollow (first hollow) having a cross section area (first cross section area) of 1.77 $mm^2$ (diameter $\varphi$=1.5 mm) in a perpendicular cross section perpendicular to the first direction, and a plurality of samples (comparative example 2, and examples 7 to 18) including a longitudinal hollow (first hollow) having a cross section area (first cross section area) of 4.90 $mm^2$ (diameter $\varphi$=2.5 mm) therein were prepared.

The comparative examples 1 and 2 are samples without the above-described second hollow. The examples 1 to 18 are samples having the second hollow. In the examples 1 to 18, the length of the first hollow in the first direction is 10 mm. In such a case, the examples 1 to 18 are obtained by changing, as shown in FIG. 8, the cross section area of the second hollow (diameter φ), the length of the second hollow in the first direction (length), the circumferential length of the second hollow in the perpendicular cross section perpendicular to the first direction (flow path circumferential length), and the second cross section area of the second hollow in the perpendicular cross section perpendicular to the first direction (flow path cross section area).

In such a case, provided that a smoking capacity is 55 ml (corresponds to a cigarette), an experiment was carried out on a temperature decrease rate relative to a case where the air was not narrowed, for the comparative examples 1 and 2.

As shown in FIG. 8, in the examples 1 to 18 having the second hollow, it was confirmed that an effect of decreasing a temperature was obtained. In particular, when the "flow path cross section area/(flow path circumferential length× length)", that is, when the above-described "S/(C×L2)" was 0.06 or less, it was confirmed that the temperature decrease rate relative to a case where the air was not narrowed was 70% or less (see the examples 5, 7, 8, and 11 to 15).

Further, as shown in the examples 1 to 18, when the second cross section area (flow path cross section area) was 1.54 $mm^2$ or less and the length of the second hollow was 2 mm or more and 13 mm or less, it was confirmed that an effect of decreasing a temperature was obtained. In particular, when the second cross section area (flow path cross section area) was 1.13 $mm^2$ or less and the length of the second hollow was 5 mm or more and 11 mm or less, it was confirmed that the temperature decrease rate relative to a case where the air was not narrowed was 70% or less (see the examples 5, 7, 8, and 11 to 15).

It is noted that when the "flow path cross section area/(flow path circumferential length×length)", that is, the above-described "S/(C×L2)" was less than 0.019, it was confirmed that the ventilation resistance of the longitudinal hollow rises too highly and the inhibition of suction of the air was restrained. However, such a sample is omitted in FIG. 8.

Figure 9:
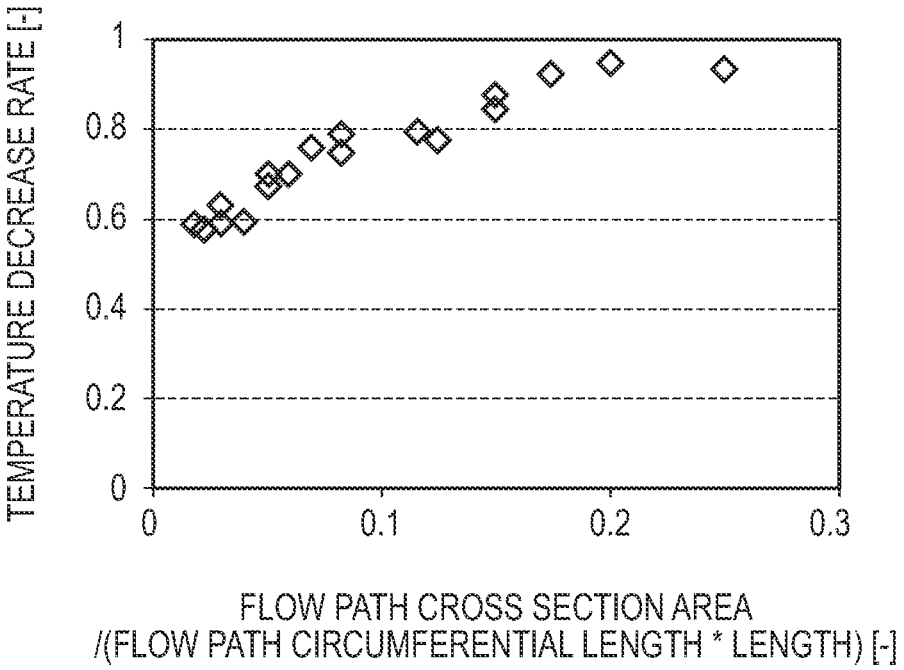
FIG. 9 is a drawing for describing an experiment result.

Further, a relationship between the temperature decrease rate relative to a case where the air is not narrowed and the "flow path cross section area/(flow path circumferential length×length)" for some samples shown in FIG. 8 is shown in FIG. 9. In FIG. 9, the horizontal axis is "flow path cross section area/(flow path circumferential length×length)" and the vertical axis is the temperature decrease rate relative to a case where the air is not narrowed.

As shown in FIG. 9, it was confirmed that as the "flow path cross section area/(flow path circumferential length× length)" was smaller, the temperature decrease rate relative to a case where the air was not narrowed was smaller. That is, it was confirmed that as the "flow path cross section area/(flow path circumferential length×length)" was smaller, an effect of decreasing a temperature was larger.

In other words, when the smoking capacity is constant, as the "flow path cross section area" is smaller, an effect of decreasing a temperature is larger. Further, as the "flow path circumferential length×length" is larger, a heat exchange is accelerated, and thus, an effect of decreasing a temperature is larger.

[First Modification]

A first modification of the first embodiment will be described, below. Description proceeds with a particular focus on a difference from the first embodiment, below.

Figure 10:
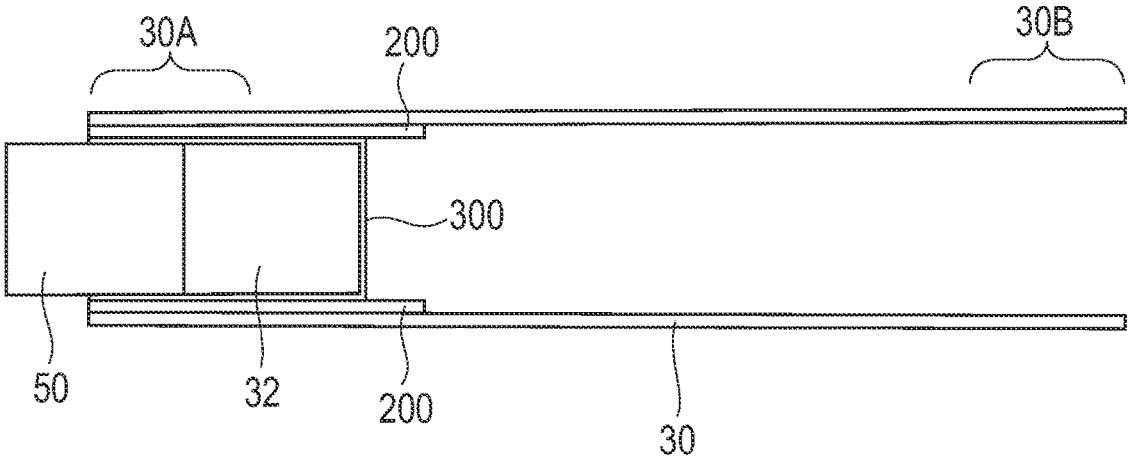
FIG. 10 is a drawing showing a flavor inhaler according to a first modification.
Figure 11:
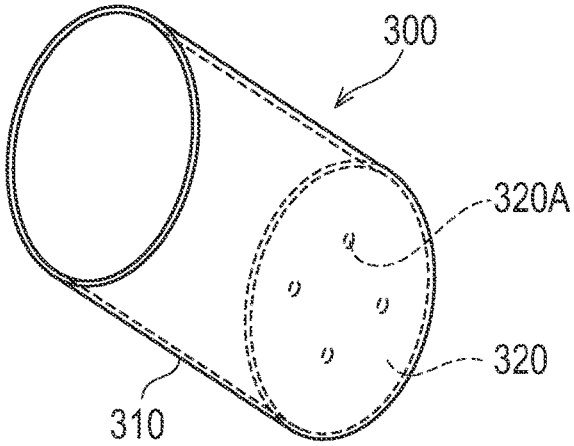
FIG. 11 is a drawing showing a cup member 300 according to the first modification.

Although not particularly mentioned in the first embodiment, in the first modification, as shown in FIG. 10, the flavor inhaler has a heat conduction member 200 and a cup member 300, in addition to the holder 30 and the burning type heat source 50.

The heat conduction member 200 is provided on an inner surface of the holder 30 at the supporting end portion 30A of the holder 30. The heat conduction member 200 is preferably formed of a metal material having an excellent heat conductivity, and is configured of aluminum, for example. In a predetermined direction, the length of the heat conduction member 200 is preferably at least longer than the length of the cup member 300. That is, the heat conduction member 200 protrudes toward the mouthpiece side end portion 30B side relative to the cup member 300. The length of the heat conduction member 200 may be the same as the length of the holder 30.

The cup member 300 has a cup shape, houses the flavor source 32 (here, a flavor source), and holds the burning type heat source 50.

The cup member 300 is configured to be inserted into the supporting end portion 30A of the holder 30. In particular, the cup member 300 is configured by a bottom plate 320 blocking a tubular side wall 310 and one opening configured by the side wall 310. The flavor source 32 (here, a flavor source) and the burning type heat source 50 are inserted into the cup member 300 from one opening configured by the side wall 310. The bottom plate 320 has a plurality of air holes 320A through which air passes.

Here, the flavor source 32 (here, a flavor source) is configured by a powdery and granular tobacco leaf, for example. In such a case, the size of the air hole 320A is smaller than a particle diameter of the tobacco leaf.

In the first modification, the thickness of the side wall 310 is preferably 0.1 mm or less. As a result, a heat capacity of the side wall 310 is small, and the heat generated from the burning type heat source 50 is efficiently transmitted to the flavor source. Further, the side wall 310 is preferably configured by SUS (for example, SUS 430). As a result, even when the thickness of the side wall 310 is 0.1 mm or less, it is possible to obtain a sufficient strength as the strength of the side wall 310 and possible to maintain the shape of the cup member 300. It is noted that the bottom plate 320 is preferably configured by the same member (for example, SUS 430) as the side wall 310.

OTHER EMBODIMENTS

The present invention is explained through the above embodiment, but it must not be assumed that this invention is limited by the statements and the drawings constituting a part of this disclosure. From this disclosure, various alternative embodiments, examples, and operational technologies will become apparent to those skilled in the art.

In the embodiment, the holder 30 houses the flavor source 32 formed in a columnar shape, which is formed by covering the powdery and granular tobacco leaf with a sheet having air permeability. However, the embodiment is not limited thereto. The holder 30 may house a filter (hereinafter, "capsule filter") incorporating a capsule for housing menthol, for example. The capsule filter is arranged at a mouthpiece side relative to the flavor source 32.

In the embodiment, a feature that the flavor source 32 is formed in a columnar shape, which is formed by covering the powdery and granular tobacco leaf with a sheet having air permeability, is described. However, the flavor source 32 is not limited thereto. The flavor source 32 may carry a flavor ingredient such as menthol.

In the embodiment, as the manufacturing method of the burning type heat source 50, a case where the first tubular member (see FIG. 6) is formed by dual extrusion is described. However, the embodiment is not limited thereto. For example, the first tubular member may be formed by pressure (compression) forming, injection molding, machine processing, etc.

In the embodiment, a case where the burning type heat source 50 is a carbon heat source is described. However, the embodiment is not limited thereto. For example, the burning type heat source 50 may be configured by pulp or a shredded tobacco.

In the embodiment, a case where the outer layer 52 and the inner layer 53 are separated from each other is described. However, the embodiment is not limited thereto. For example, the outer layer 52 and the inner layer 53 may be configured as one body by using a substance similar to that of the above-described outer layer 52. In such a case, the inner surface of the inner layer 53 is preferably coated with a nonallergic agent or a flame retardant.

In addition, the entire content of Japanese Patent Application No. 2013-43279 (filed on Mar. 5, 2013) is incorporated in the present specification by reference.

INDUSTRIAL APPLICABILITY

According to the present invention, it is possible to provide a burning type heat source, a flavor inhaler, and a manufacturing method of the burning type heat source with which it is possible both to supply a stable heat amount in a puff performed from the middle to the latter half and to restrain a flame of a gas lighter from flowing into during ignition.

The invention claimed is:

1. A burning type heat source extending along a first direction from an ignition end toward a non-ignition end, the burning type heat source having a single longitudinal hollow extending along the first direction, wherein the longitudinal hollow includes:

a first hollow having a first cross section area in a perpendicular cross section perpendicular to the first direction;

a second hollow located at a non-ignition end side relative to the first hollow, the second hollow having a second cross section area smaller than the first cross section area in the perpendicular cross section, and an inner wall consisting of a nonflammable substance and forming the second hollow is configured by calcium carbonate, silicon dioxide, titanium oxide, or iron oxide.

2. The burning type heat source according to claim 1, wherein the second hollow satisfies a condition of $S/(C \times L2) < 0.25$, where S is the second cross section area, C is a circumferential length of the second hollow in the perpendicular cross section, and L2 is a length of the second hollow in the first direction.

3. The burning type heat source according to claim 2, wherein the second hollow satisfies a condition of $S/(C \times L2) \leq 0.06$, where S is the second cross section area, C is a circumferential length of the second hollow in the perpendicular cross section, and L2 is a length of the second hollow in the first direction.

4. The burning type heat source according to claim 2, wherein the second hollow satisfies a condition of $S/(C \times L2) \geq 0.019$.

5. The burning type heat source according to claim 2, wherein the second cross section area is 1.54 $mm^2$ or less, and a length of the second hollow in the first direction is 2 mm or more and 13 mm or less.

6. The burning type heat source according to claim 3, wherein the second cross section area is 1.13 $mm^2$ or less, and a length of the second hollow in the first direction is 5 mm or more and 11 mm or less.

7. The burning type heat source according to claim 1, wherein the burning type heat source has a cylindrical shape extending along the first direction, and an outer diameter of the burning type heat source is 3 mm or more and 15 mm or less.

8. The burning type heat source according to claim 1, wherein a length of the burning type heat source in the first direction is 5 mm or more and 30 mm or less.

9. The burning type heat source according to claim 1, wherein the first cross section area is 1.77 $mm^2$ or more.

10. A flavor inhaler including:

a burning type heat source extending along a first direction from an ignition end toward a non-ignition end and having a single longitudinal hollow extending along the first direction; and a holder that holds the burning type heat source, wherein the longitudinal hollow includes:

a first hollow having a first cross section area in a perpendicular cross section perpendicular to the first direction; and a second hollow located at a non-ignition end side relative to the first hollow, the second hollow having a second cross section area smaller than the first cross section area in the perpendicular cross section, and an inner wall consisting of a nonflammable substance and forming the second hollow is configured by calcium carbonate, silicon dioxide, titanium oxide, or iron oxide.

11. The flavor inhaler according to claim 10, wherein the first cross section area is 1.77 $mm^2$ or more.

12. The flavor inhaler according to claim 10, wherein the burning type heat source has a cylindrical shape extending along the first direction, and an outer diameter of the burning type heat source is 3 mm or more and 15 mm or less.

13. The flavor inhaler according to claim 10, wherein a length of the burning type heat source in the first direction is 5 mm or more and 30 mm or less.

* * * * *